United States Patent [19]

Ecker et al.

[11] 4,307,596

[45] Dec. 29, 1981

[54] ROLLER BLOCK, IN PARTICULAR FOR A ROLLER STRAIGHTENING MACHINE

[75] Inventors: Karl-Heinz Ecker; Karl-Heinz Wahl, both of Erkelenz, Fed. Rep. of Germany

[73] Assignee: Wirth Maschinen-und Bohrgerate-Fabrik GmbH, Erkelenz, Fed. Rep. of Germany

[21] Appl. No.: 84,507

[22] Filed: Oct. 12, 1979

[30] Foreign Application Priority Data

Oct. 19, 1978 [DE] Fed. Rep. of Germany ... 7831121[U]

[51] Int. Cl.[3] ..... B21B 31/08

[52] U.S. Cl. ..... 72/239

[58] Field of Search ..... 72/239, 238, 163, 160

[56] References Cited

U.S. PATENT DOCUMENTS 3,459,023 8/1969 Adair ..... 72/238

3,864,954 2/1975 Elbe et al. ..... 72/239

*Primary Examiner*—Milton S. Mehr

*Attorney, Agent, or Firm*—Holman & Stern

[57] ABSTRACT

A roller block comprising a frame, a carriage vertically displaceable relative to the frame and having upwardly open or openable holders for the two ends of a roller unit which has a horizontal shaft or axis with at least one roller arranged thereon, and two bearers displaceable between a lowered position and a raised effective position, wherein the upper ends of the bearers form or are provided with bearing members for end members of the roller unit, which bearers are retainable in the raised position thereof independently of the carriage.

10 Claims, 5 Drawing Figures

ROLLER BLOCK, IN PARTICULAR FOR A ROLLER STRAIGHTENING MACHINE

BRIEF SUMMARY OF THE INVENTION

This invention relates to a roller block for use in an adjusting machine, in particular in a roller straightening machine, particularly a roller block of the type comprising a frame and a carriage which is vertically displaceable relatively thereto and which has upwardly open or openable holders for the two ends of a roller unit which has a horizontal shaft or axis with at least one roller arranged thereon.

Such roller blocks are found in particular in roller straightening machines for rod material or profiled material at the inlet end and/or at the outlet end of such machines. In this case the roller or rollers of such a block may have a smooth periphery, or may have or even form a profile. They may serve by themselves for the conveyance of material to be straightened or to be treated in some other way, or alternatively they may even take part directly in the work operation to be performed, for example a straightening process.

In order to interchange a roller, e.g. when wear has occurred, or when a roller having one profile is to be interchanged with a roller having another profile, the entire roller unit must always be removed from the roller block. This requires special measures and causes a corresponding expenditure of time; just the process of loosening or lifting the roller unit out of the block often presents difficulties. This applies to a particular degree to large roller units which for this reason are difficult to handle, as well as to heavy roller units.

It is an object of the present invention to overcome [illegible]ing disadvantages and defects and to facilitate, in respect of a roller block of the kind referred to, the removal of the roller unit from the block and the insertion of such a unit into the block, respectively.

The present invention provides a roller block, comprising a frame, a carriage vertically displaceable relative to the frame and having upwardly open or openable holders for the two ends of a roller unit which has a horizontal shaft or axis with at least one roller arranged thereon, and two bearers displaceable between a lowered position and a raised effective position, wherein the upper ends of the said bearers form or are provided with bearing members for end members of the roller unit, which bearers are retainable in the said raised position indpendently of the carriage.

Such a roller block renders it possible to intercept the roller unit in an upper position of the carriage by means of the bearers raised to the effective position, while the carriage is moved downwards. Thereby the roller unit is released from the carriage and rests upon the bearers, so that is easily accessible and can be removed immediately by means of a lifting mechanism or a conveyor apparatus and conveyed to the desired location. Another roller unit can be placed upon the bearers in the same simple manner and then introduced into the holders located on the carriage by displacing the latter upwards, without further operating steps being necessary for this purpose. After the bearers have been released, they can return to their lowered rest position, whereupon the roller block is ready again for use. The bearers may be quite simple parts which are preferably produced from rod material or profiled material.

The bearers are preferably raisable to the effective position by means of the carriage. This may be effected in a simple manner by means of coupling elements, so that therefore a separate drive for raising the bearers is not required. In particular the bearers may be provided with abutments which are located in the path of projections or other driver members on the carriage. The abutments of the bearers may be suitably formed by shoulders or collars. Alternatively, adjuster rings or similar elements may be provided for this purpose.

The carriage may be suitably provided with guides for the bearers which always hold the latter in an aligned position. Furthermore, two guides may simultaneously form driver members for abutments on the bearers.

The undersides of the end members of the roller unit may be advantageously provided with centering recesses for receiving the upper ends of the bearers. In particular, these recesses may have totally or partly a conical shape, in which case the upper ends of the bearers are constructed in a corresponding conical manner. Thereby perfect engagement between the mutually co-operating parts may be obtained and the correct position of the roller unit during release from the carriage and during insertion into the holders on the carriage, respectively, is ensured.

Various possibilities exist for retaining the bearers in their raised effective position. In a very simple and advantageous embodiment detent members may be provided which have support surfaces for the lower ends of the bearers, which support surfaces may be displaced into the movement region of the bearers. In this case each of the detent members may be suitably rotatable through 90° about an axis which crosses the movement axis of the respective bearer and provided with a passage opening for the bearer, which opening extends parallel to the support surface of the detent member. This passage opening permits free up and down movement of the associated bearer in the non-retained state of the latter and may even simultaneously form a guide for the same.

BRIEF DESCRIPTION OF THE DRAWINGS

The invention will be further described, by way of example only, with reference to the accompanying drawings, in which.

DETAILED DESCRIPTION

Figure 2:
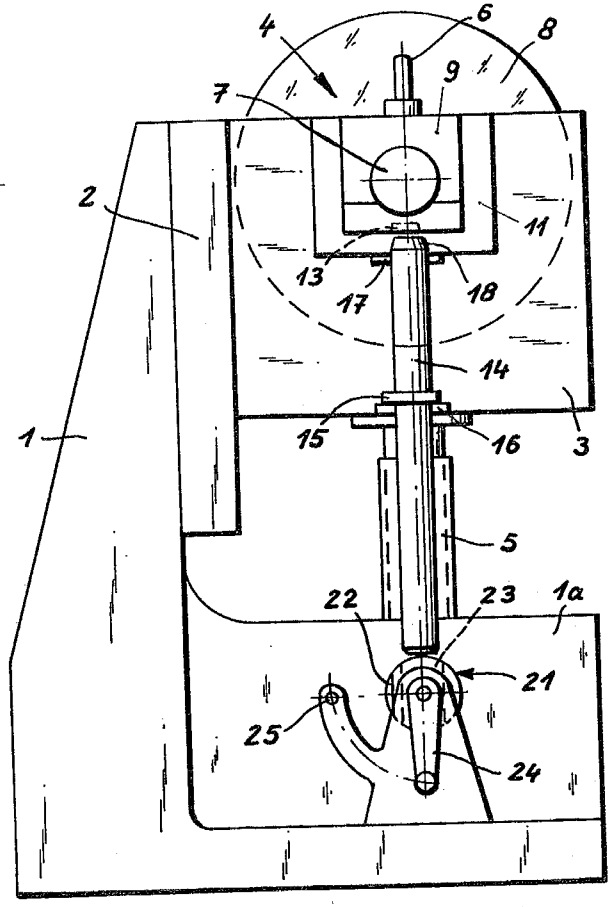
FIG. 2 is a side view of the roller block shown in FIG. 1.

The roller block shown in the drawings comprises a stand-like frame 1 and a carriage 3 which is displaceable along vertical guides 2 of the frame 1 and which forms a bearing casing for a roller unit 4. A screw-threaded spindle 5 serves for vertical displacement of the carriage 3 and can be rotated in both directions by means of a motor located in the lower portion 1*a* of the frame.

The roller unit 4, which is provided with eyelets 6 for attachment to a lifting mechanism, comprises a support shaft 7 for a roller 8 which is interchangeably fixed thereon and which may alternatively carry a profile or may be put together from a plurality of parts, as well as two end members 9 and 10. The end member 9 forms a slide block which is insertable into an upwardly open holder 11 of the carriage 3 and is supported by the latter. The other end member 10 engages by means of a profiled abutment into an upwardly open holder 12 which has a corresponding profile and which forms at the same time an axial holder for the end member 10. The axial holder 12 may be adjustable for the purpose of adjustment.

A vertical bearer 14 formed by a round rod or the like is arranged on each side of the carriage 3 and is provided with a collar 15, for example in the form of an adjuster ring fixed thereon. The carriage 3 is provided with ring-like guides 16, 17 for the bearers 14, the guides being spaced from each other in the vertical direction. The collars 15 on the bearers 14 are located in the region between these guides 16, 17. The lower guides 16 serve at the same time as driver members for the bearers 14 during the upward movement, the collars 15 being placed thereby upon these guides 16. The upper ends 18 of the bearers form supports for the end members 9, 10 of the roller unit 4 during insertion and removal of the latter. The undersides of the end members 9, 10 have conical recesses 13 into which may enter the correspondingly conically constructed upper ends 18 of the bearers. Thereby a reliable support and at the same time also centering is obtained.

Figure 1:
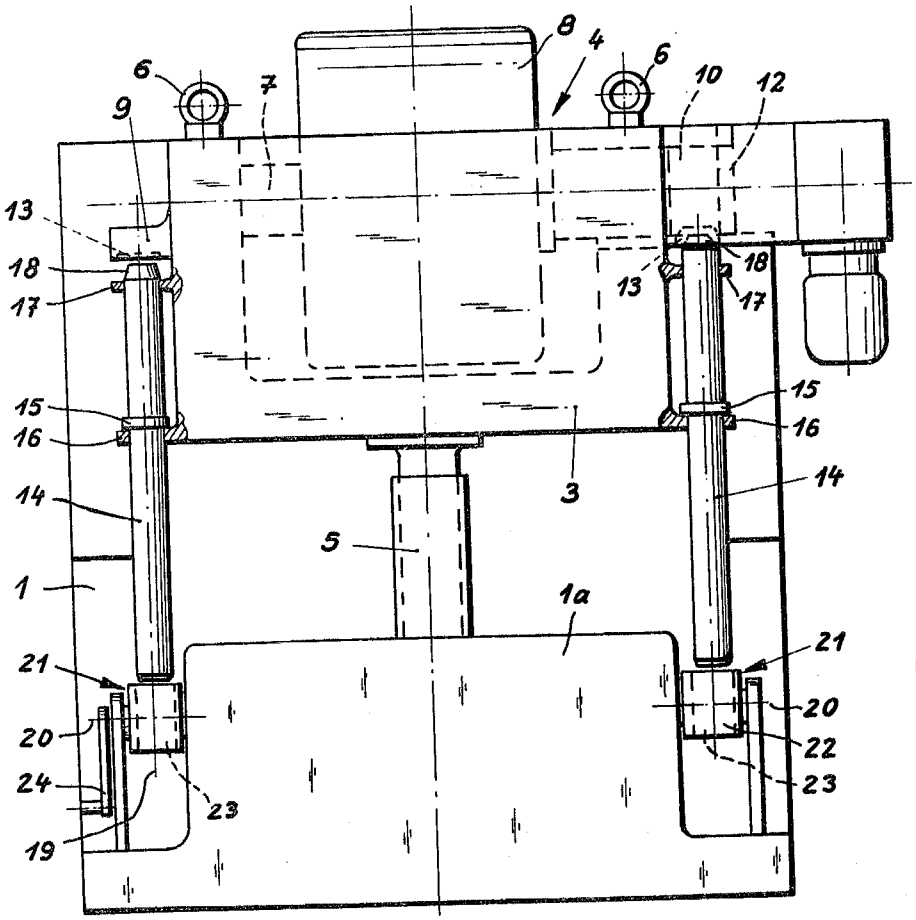
FIG. 1 is a front elevational view of a roller block according to the invention with the carriage thereof driven upwards and with raised, but not retained, bearers.
Figure 4:
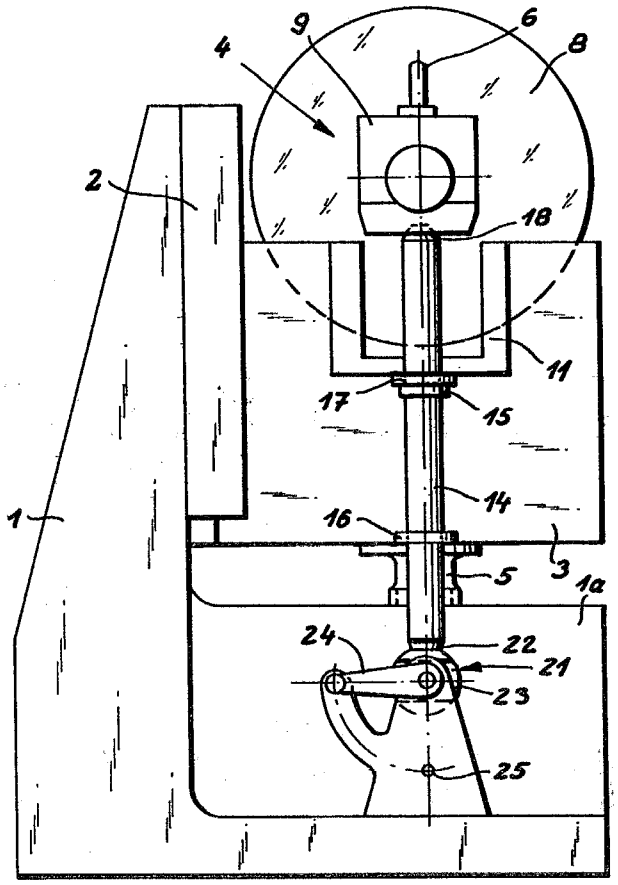
FIGS. 3 and 4 are front and side views corresponding to FIGS. 1 and 2 respectively with retained bearers in the effective position and with the carriage driven downwards.
Figure 3:
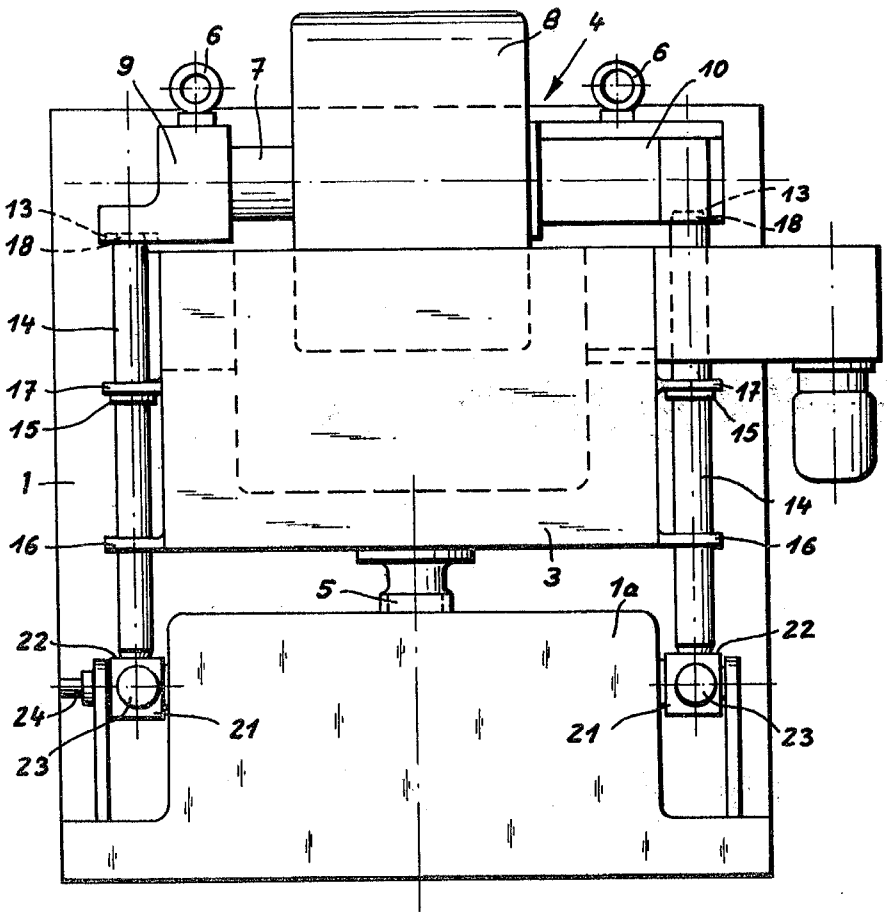
Figure 5:
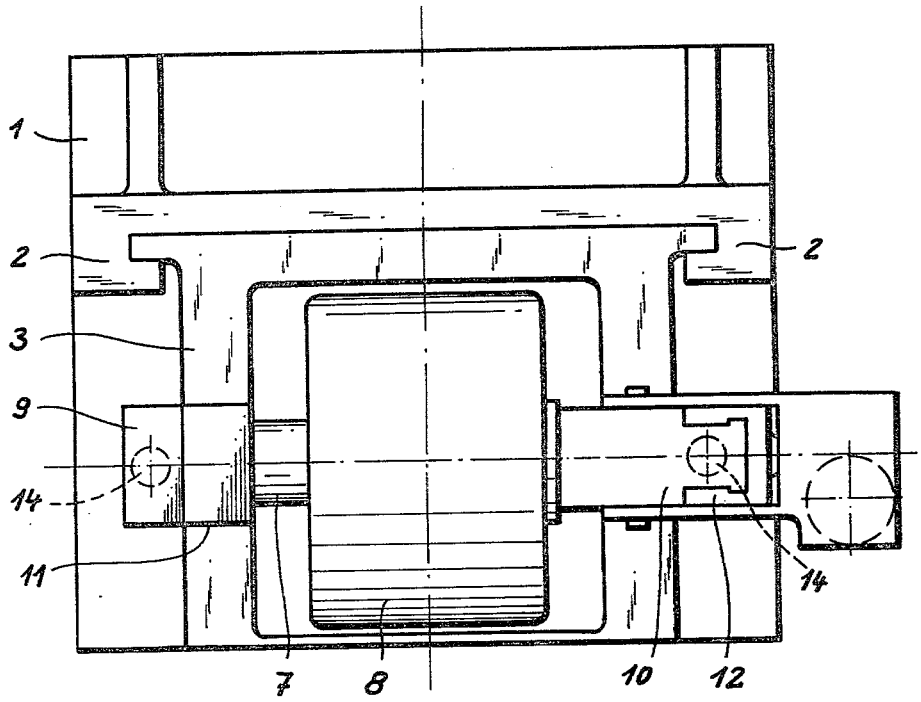
FIG. 5 shows the roller block from above.

The lower portion 1*a* of the frame 1 is provided with detent members 21 each of which is rotatable through 90° about an axis 20 which crosses the movement axis 19 of the bearers 14, from the position illustrated in FIGS. 1 and 2 into the position illustrated in FIGS. 3 and 4, e.g. by means of a hand grip 24. The respective position of the detent members 21 can be secured by inserting a detent pin or the like into appropriate bores 25. Each detent member has a support surface 22 and a passage opening 23 extending parallel thereto.

The removal of the roller unit 4 is effected as follows.

If the carriage 3 is located for example in a lower or intermediate position, it is driven to its upper end position by means of the spindle 5, the upper end position being shown in FIGS. 1 and 2. During this upward movement, the carriage 3 simultaneously raises the bearers 14, since the collars 15 are engaged from below by the guides 16 on the carriage which operate as driver members. In FIGS. 1 and 2 the bearers 14 have therefore attained their raised position.

The detent members 21, the passage openings 23 of which have hitherto permitted the bearers 14 to pass therethrough, are rotated by means of the handgrip 24 into the position shown in FIGS. 3 and 4 and the carriage 3 is displaced downwards by means of the spindle 5. Thereby the lower ends of the bearers 14 are placed upon the support surfaces 22 of the detent members 21, whereas their upper ends 18 enter into the recesses 13 of the end members 9, 10 of the roller unit 4 and thus intercept the latter during continued downward movement of the carriage 3. At the same time the end members 9, 10 of the roller unit 4 slide out of their holders 11, 12 on the carriage 3, until the position shown in FIGS. 3 and 4 is obtained in which the roller unit 4 can then be removed by means of a lifting mechanism or the like.

The re-insertion of the roller unit, or the insertion of another unit, is effected in the reverse manner. After the roller unit 4 has been placed upon the upper ends 18 of the retained bearers 14, the carriage 3 is driven into its upper end position, whereby the end members 9, 10 of the roller unit 4 are inserted into the holders 11, 12 on the carriage 3. After the detent members 21 have been swung back into the position shown in FIGS. 1 and 2, the carriage 3 can be lowered to the desired position, whereby the bearers 14 are simultaneously moved downwards and their lower portions can pass through the passages 23 in the detent members 21.

The interchange of a roller unit may take place simultaneously with an interchange of straightening rollers of an associated roller straightening machine, so that no additional time is required.

The roller block may be arranged by itself, e.g. in front of a straightening machine or another adjusting machine. Alternatively, however, it may be incorporated in such a machine or form a part thereof.

The invention is not of course limited to the construction illustrated, e.g. the bearers may have a different construction, and for example a double bearer arrangement may even be provided on each side.

The motor for the vertical displacement of the carriage of the roller block may be a motor with switchable poles which permits a slow adjustment movement of the carriage as well as a rapid displacement movement. The latter may then be utilised also during the removal and the insertion, respectively, of a roller unit.

We claim:

1. A roller block, comprising a frame, a carriage guidingly supported on the frame for vertical movement relative to the frame, said carriage having upwardly open holders for the two ends of a roller unit having a horizontal axis with at least one roller arranged thereon, and two vertically disposed bearers movable between a lowered position and a raised position in which said roller is removable, the upper ends of said bearers having bearing supports, cooperating bearing surfaces on the undersides of said end members of the roller unit to receive said bearing supports, and means to retain said bearers in said raised position independently of the carriage.

2. The roller block according to claim 1, wherein means are provided on the carriage to move said bearers by movement of the carriage.

3. The roller block according to claim 2, wherein said means to move said bearers comprise abutments on the bearers and drive members on the carriage which engage said abutments.

4. The roller block according to claim 3, wherein said abutments on the bearers are formed by shoulders.

5. The roller block according to claim 3, wherein said abutments on the bearers are formed by collars.

6. The roller block according to claim 1, wherein guide means for the bearers are provided on the carriage.

7. The roller block according to claim 6, wherein there are at least two bearers and said guide means comprises at least one guide member for each bearer having driver members thereon, and abutments on the bearers engageable by said driver members so that said bearers are moved by said carriage.

8. The roller block according to claim 1, wherein said cooperating bearing surfaces on the undersides of said end members of the roller unit are centering recesses for receiving said bearing supports on the upper ends of the bearers.

9. The roller block according to claim 1, wherein said means for retaining the bearers in their raised position comprises detent members mounted on said frame having support surfaces for the lower ends of the bearers, said support surfaces being displaceable into the path of movement of the bearers.

10. The roller block according to claim 9, wherein each of the detent members is rotatable through 90° about an axis which is perpendicular to an intersects said path of movement of the respective bearer, and a passage opening is provided in each detent member for the respective bearer.

* * * * *